US007036274B2

(12) United States Patent
Carrier

(10) Patent No.: US 7,036,274 B2
(45) Date of Patent: May 2, 2006

(54) CASEMENT WINDOW OPENING AND CLOSING ASSEMBLY

(76) Inventor: Germain Carrier, 124 de la Colline, St-Lambert-de-Lévis, Quebec (CA) G0S 2W0

( * ) Notice: Subject to any disclaimer, the term of this patent is extended or adjusted under 35 U.S.C. 154(b) by 52 days.

(21) Appl. No.: 10/797,805

(22) Filed: Mar. 10, 2004

(65) Prior Publication Data

US 2005/0198905 A1 Sep. 15, 2005

(51) Int. Cl.
*E05B 65/06* (2006.01)

(52) U.S. Cl. ..... 49/394; 292/160; 292/279; 70/190

(58) Field of Classification Search ..... 49/394; 70/190, 134; 292/160, 279

See application file for complete search history.

(56) References Cited

U.S. PATENT DOCUMENTS

| | | | | | |
|---|---|---|---|---|---|
| 1,060,444 | A * | 4/1913 | Feola | ..... | 70/134 |
| 1,330,650 | A * | 2/1920 | Pehel | ..... | 70/134 |
| 2,274,854 | A * | 3/1942 | Stewart | ..... | 292/160 |
| 4,002,360 | A * | 1/1977 | Frank et al. | ..... | 292/336.3 |
| 4,848,811 | A * | 7/1989 | Laufenburg et al. | ..... | 292/142 |
| 6,076,304 | A * | 6/2000 | Carrier | ..... | 49/342 |

FOREIGN PATENT DOCUMENTS

DE 3901957 A1 * 7/1990

* cited by examiner

*Primary Examiner*—Jerry Redman
(74) *Attorney, Agent, or Firm*—Eric Fincham

(57) ABSTRACT

A window opening and closing assembly wherein a rack gear is operatively driven by a pinion gear which is connected to a handle, the arrangement being one wherein there is a pin mounted on one side of the pinion gear and which must move past a resilient element to reach the fully open and fully closed positions. The resilient element provides a firm feel to the handle. A replaceable housing member can have different configurations.

5 Claims, 3 Drawing Sheets

CASEMENT WINDOW OPENING AND CLOSING ASSEMBLY

FIELD OF THE INVENTION

The present invention relates to a window opening and closing assembly and more particularly, relates to a device suitable for opening and closing casement windows.

BACKGROUND OF THE INVENTION

Originally, almost all windows available for use in residential applications were of the guillotine type wherein the window has a fixed upper window portion and a moveable lower window portion or alternatively, the upper window portion was the moveable portion. Still further, some windows have been built such that both upper and lower portions are moveable.

Most guillotine type windows operate such that the lower window portion is lifted and retained in the desired position by means of friction. On occasion, various types of retaining members were inserted below the open window to maintain it at the desired height.

More recently, the window industry has moved to offer many different styles of windows having different operating mechanisms for opening of the same. One of the more popular types is the casement window wherein the window is hinged at a vertical side and thus opens at the other vertical side. Advantages of this window include the ability to open the same during inclement weather. The window, as aforementioned, can be hinged at either side and thus if the hinge side is closest to the direction the wind is blowing from, it can safely be opened a certain amount to provide ventilation.

As is the case with the windows, there are now many more choices as far as operating hardware is concerned. Originally, most of the devices for opening the windows have comprised a crank operated handle which operates to move an arm outwardly, and which arm has a distal end thereof seated within a channel on the window. While there are many variations of this particular arrangement, most of them are relatively minor and the system is widely used and is an accepted standard in the industry. Most of these components are formed of metallic material and must be assembled together.

In U.S. Pat. No. 6,076,304 the teachings of which are hereby incorporated by reference, there is taught a novel window opening and closing assembly which utilizes a rack slidably mounted in a housing, the rack being moveable between first and second positions, a pinion being operatively engaged with the slidable rack and with a handle having a shaft connected to the pinion such that the pinion will move along the rack within the housing and cause the opening and closing of the window.

An advantage of the above system is that it is very compact and presents an esthetically pleasing appearance. However, it is relatively expensive to manufacture and although there is a detente formed on the shaft of the handle there is no positive locking of the device in open or closed positions.

SUMMARY OF THE INVENTION

It is therefore an object of the present invention to provide a window opening and closing assembly which has an esthetic appearance and can easily be changed to have a different configuration.

It is a further object of the present invention to provide a window opening and closing assembly having a rack and pinion arrangement wherein the assembly can be locked in position.

According to one aspect of the present invention, there is provided a window opening and closing assembly comprising a first and second member, a rack gear slidably mounted between the first and second member, a pinion gear operatively engaged with the rack gear, a handle having a handle shaft connected to the pinion gear whereby rotatable movement of the handle shaft will cause the pinion to move the rack gear, a pin mounted on one side of the pinion gear, the pin moving from a first position when the handle is in a fully open position to a second position when the handle is in a fully closed position. A resilient element is mounted in the path of the pin proximate each of the first and second positions, the arrangement being such that as the pin approaches either of the first and second positions, the pin will contact one of the resilient elements to thereby cause the resilient element to temporarily deflect to permit passage of the pin. The resilient element then returns to its original position after passage of the pin and thereby retains the pin in the desired position.

In a still further aspect of the present invention, there is provided a window opening and closing assembly comprising first and second member, a rack gear and a pinion gear mounted between the first and second members, the first and second members being secured together to hold the rack gear and the pinion gear in a desired position the rack gear being slidably mounted and moveable between first and second positions, the rack gear having a tongue extending exteriorly from between the first and second members, the pinion gear being operatively engaged with the rack gear, a handle having a handle shaft connected to said pinion gear whereby rotatable movement of the handle shaft will cause the pinion to move the rack gear within the housing between the first and second positions, and a housing member having an interior cavity, the housing member enclosing the first and second members within the cavity, the housing having means for releaseable securement to one of the second members.

The use of the resilient members provides a firm "feel" to the handle when it is either in the fully open or fully closed position. Thus, the pin mounted on the pinion gear is prevented from moving past the resilient element without a reasonable amount of force being placed on the handle.

In the preferred embodiment, the assembly has a separate housing which can readily be changed to have many different configurations without having to change the mechanical working components of the window opening and closing assembly. This is a substantial advantage both from the point of view of ease of manufacture as many different models can be fabricated with just the exterior housing being different. Also, it provides advantages for the user as the decor can easily be changed.

The window opening and closing assembly may be formed of either metallic or plastic material or indeed combinations of these materials could be utilized.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
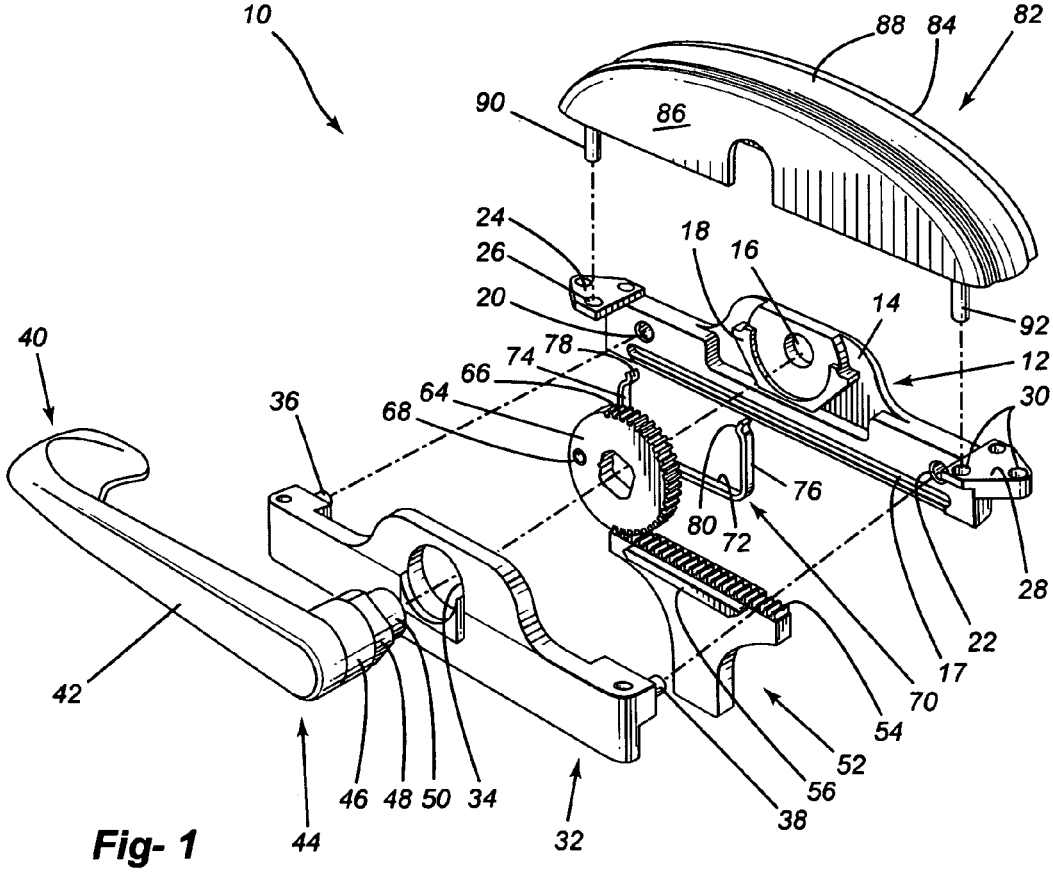
FIG. 1 is a an exploded view of a window opening and closing mechanism according to an embodiment of the present invention.
Figure 2:
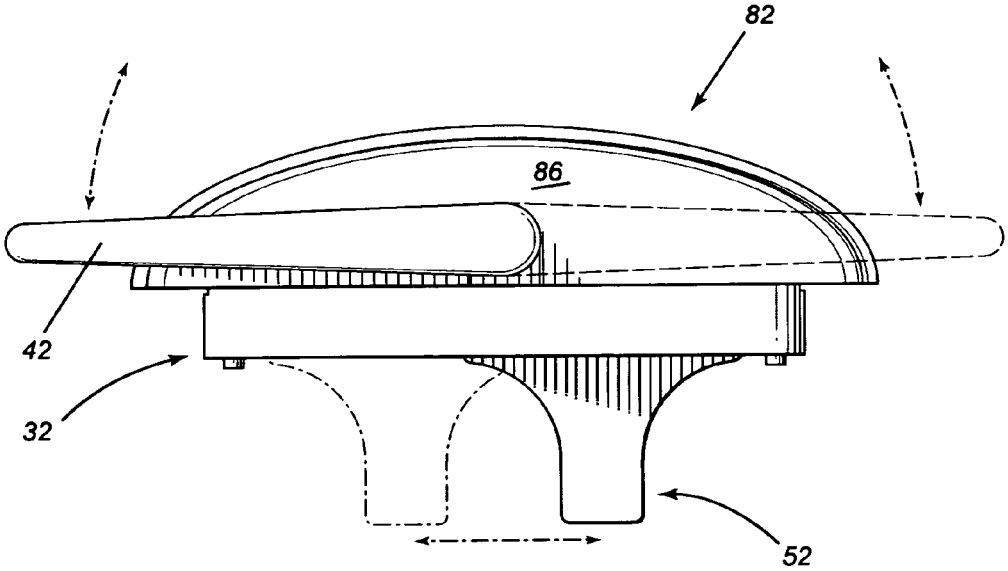
FIG. 2 is a top plan view of an assembled mechanism.
Figure 3:
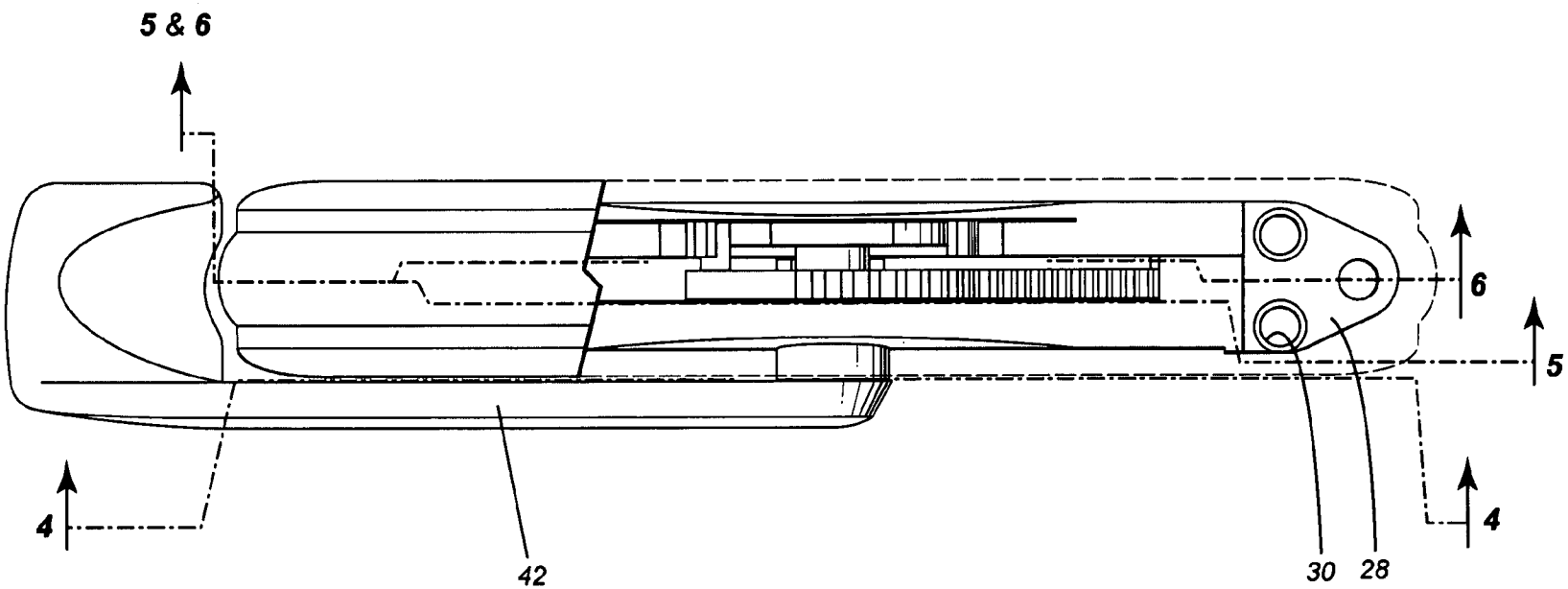
FIG. 3 is a front elevational view, partially in cut away, of an assembly according to the present invention.
Figure 4:
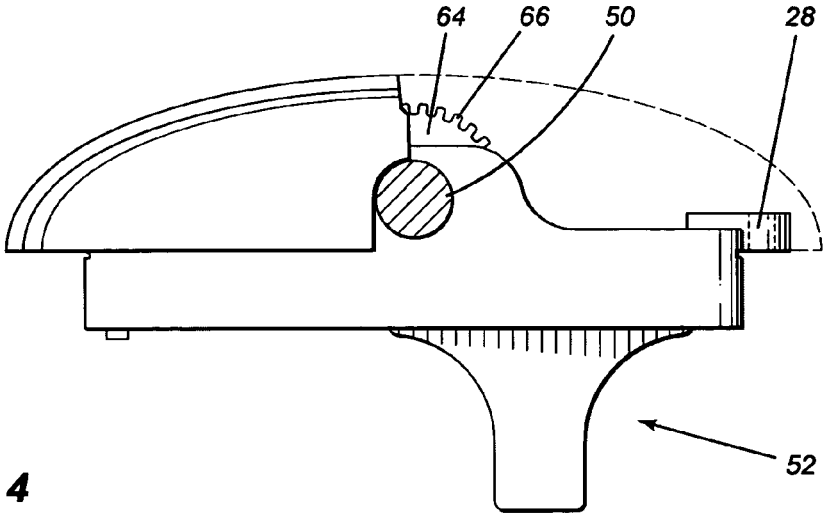
FIG. 4 is a top plan view thereof, partially in cut away.

Referring to the drawings in greater detail and by reference characters thereto, there is illustrated in FIG. 1, an exploded view of a window opening and closing mechanism according to the present invention and which mechanism is generally designated by reference numeral 10.

The window opening and closing mechanism 10 includes a first member generally designated by reference numeral 12 and which first member 12 has a recessed portion generally designated by reference numeral 14. Provided within recessed portion 14 is an aperture 16. Surrounding aperture 16 is a raised land portion 18 for reasons which will be described hereinbelow. A longitudinal slot 17 is also provided therein. Within first member 12, there is provided a first aperture 20 and a second aperture 22 proximate opposite sides thereof.

There is also provided, at one side of member 12, a first ear 24 having apertures 26 formed therein while at the other side there is a second ear 28 having apertures 30 formed therein.

Figure 5:
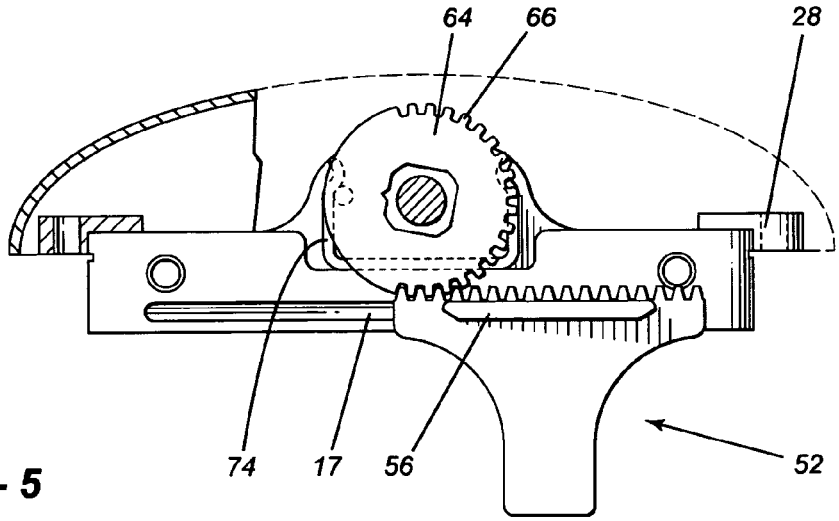
FIG. 5 is a top plan view similar to FIG. 4 with portions of the cover completely removed.

A second member generally designated by reference numeral 32 has a centrally located aperture 34 as may be seen in FIG. 1. Second member 32 also has a longitudinally extending slot 35 (see FIG. 5) along with a pair of studs 36, 38 located on opposite sides thereof.

A handle member generally designated by reference numeral 40 has a grasping portion 42 and a shaft generally designated by reference numeral 44. Shaft 44 has a first circular portion 46 designed to fit within aperture 34 of second member 32; a rectangular portion 48 for reasons which will be discussed herein below; and a distal circular portion 50 which is adapted to fit within aperture 16 of first member 12.

A rack gear generally designated by reference numeral 52 has a guiding element 56 which is designed to fit within longitudinal slot 35 of second member 32. On the other side of rack gear 52 there is likewise provided a guiding element designed to fit within longitudinal slot 17 of first member 12. Rack gear 52 also includes an actuating portion 60 which would be operatively connected to the window to be opened or closed.

The assembly also includes a pinion gear generally designated by reference numeral 64 and which pinion gear 64 has teeth 66 formed on the least a portion of the outer circumference. The pinion 68 extends outwardly from one side of the arm for reasons which will become apparent hereinbelow.

A spring member generally designated by reference numeral 70 includes a base 72, a first leg 74, and a second leg 76 to thus have an overall U-shaped configuration. In addition, in leg 74, there is provided a U-shaped formation 78 while a similar U-shaped formation 80 is provided in leg 76.

The assembly also includes a housing member 82 which, as may be seen in FIG. 1, has a front wall 84 and an opposite back wall 86. A side wall 88 extends between front wall 84 and back wall 86 in an arcuate configuration such that housing 82 has a crescent-shaped configuration. As will be noted, a pair of studs 90, 92 extend outwardly therefrom and which studs are designed to engage with apertures 26 and 30 of ears 24, 28 respectively.

Figure 6:
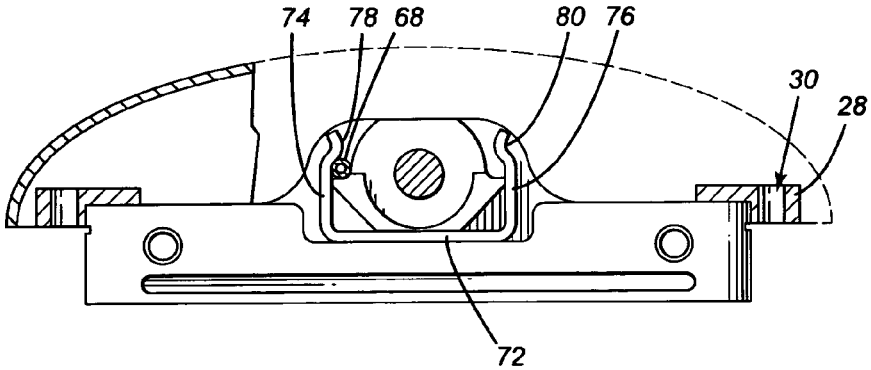
FIG. 6 is a bottom plan view thereof.

Spring 70 is placed in position and is retained by raised land portion 18 of first member 12. When assembled, handle 40 is rotated causing movement of pinion gear 64 which will in turn drive rack gear 52. At either extremity, in the fully open or closed position, pin 68 of pinion gear 64 is designed to be retained in position of one of U-shaped portions 78, 80 as is shown in FIG. 6. Thus, pin 68 is retained in position by the resiliency of the U-shaped portions 78, 80.

It will be understood that the above described embodiment is for purposes of illustration only and that changes and modifications may be made thereto without departing from the spirit and scope of the invention.

I claim:

1. A window opening and closing assembly comprising:

a first member and a second member;

a rack gear slidably mounted between said first member and said second member;

a pinion gear operatively engaged with said rack gear;

a handle having a handle shaft connected to said pinion gear whereby rotatable movement of said handle shaft will cause said pinion to move said rack gear;

a pin mounted on one side of said pinion gear, said pin moving from a first position when said handle is in a fully open position to a second position when said handle is in a fully closed position;

a resilient element mounted in the path of said pin proximate each of said first and second positions, the arrangement being such that as said pin approaches either of said first and second positions, said pin will contact one of said resilient elements to thereby cause said resilient element to temporarily deflect to permit passage of said pin, said resilient element returning to an original position after passage of the pin to thereby retain the pin in the desired position.

2. The window opening and closing assembly of claim 1 wherein said first member and said second member each have a groove formed on an interiorly facing wall thereof, said rack gear having a flange extending outwardly on each side thereof, said flanges being slidably engaged in said grooves.

3. The window opening and closing assembly of claim 1 wherein said resilient elements comprise a spring member mounted between said first member and said second member, said spring member having a base and a pair of legs, each one of said legs having a notch formed therein to thereby form said resilient element.

4. The window opening and closing assembly of claim 1 wherein said handle moves through substantially 180° when said handle moves from said fully opened position to said fully closed position.

5. The window opening and closing assembly of claim 1 further including a housing member securing said first member and said second member together and enclosing said rack gear and said pinion gear.

* * * * *